US006231499B1

(12) United States Patent
Jones

(10) Patent No.: US 6,231,499 B1
(45) Date of Patent: May 15, 2001

(54) LIFT MECHANISM FOR INFANT CARE APPARATUS CANOPY

(75) Inventor: Thomas C. Jones, Columbia, MD (US)

(73) Assignee: Datex-Ohmeda, Inc., Tewsbury, MA (US)

( * ) Notice: Subject to any disclaimer, the term of this patent is extended or adjusted under 35 U.S.C. 154(b) by 0 days.

(21) Appl. No.: 09/316,506

(22) Filed: May 21, 1999

(51) Int. Cl.[7] ..... A61G 11/00
(52) U.S. Cl. ..... 600/22
(58) Field of Search ..... 600/21, 22; 5/600, 5/603, 97, 284, 414

(56) References Cited

U.S. PATENT DOCUMENTS

| | | | | |
|---|---|---|---|---|
| 3,858,570 | | 1/1975 | Beld et al. . | |
| 4,802,198 | | 1/1989 | Guenther . | |
| 4,955,046 | | 9/1990 | Siczek et al. . | |
| 5,453,077 | | 9/1995 | Donnelly et al. . | |
| 5,830,123 | * | 11/1998 | Franz et al. | 600/22 |
| 6,022,310 | * | 2/2000 | Goldberg et al. | 600/22 |

* cited by examiner

*Primary Examiner*—Samuel G. Gilbert
(74) *Attorney, Agent, or Firm*—Roger M. Rathbun

(57) ABSTRACT

An infant care apparatus that has a canopy that can be moved vertically with respect to an infant pedestal on which the infant is positioned. In the preferred embodiment, the canopy contain a radiant heater that can be moved from a lower position enclosing the infant in an infant compartment to an upper position where the infant compartment is open. The canopy is affixed to a movable frame member that is, in turn, movably mounted on a stationary frame member. A constant force spring or springs are used to interconnect between the stationary frame member and the movable frame member and the springs are designed so as to achieve a counterbalancing of the canopy and associated components such that the weight of such canopy and components is neutralized. Thus, a standard, inexpensive motor can be used to raise and lower the canopy without complex synchronization between two motors and yet the unit moves smoothly and without misalignment. In addition, two sets of stationary and movable frame members can be used and position the motor and its lifting mechanism in only one of the sets of frame members without creating a misalignment of the frame members as the canopy is raised and lowered.

7 Claims, 6 Drawing Sheets

LIFT MECHANISM FOR INFANT CARE APPARATUS CANOPY

BACKGROUND

The present invention relates to an infant warming apparatus and, more particularly, to an apparatus for providing the combined functions of an infant incubator and an infant warmer and which includes a radiant heater contained within a housing.

There are, of course, many devices or apparatus for the warming of an infant and to supply the necessary heat to maintain the infant at a predetermined temperature. Of the various apparatus, there are infant warmers that are basically planar surfaces on which the infant is positioned and which planar surfaces generally include side guards to keep the infant safely within the confines of the apparatus. Infant warmers normally have an overhead radiant heater that is located above the infant and which thus radiates energy in the infrared spectrum to impinge upon the infant to maintain the infant at a warm, predetermined temperature. Since the infant is otherwise totally exposed to the surroundings, there is almost unlimited access to the infant by the attending personnel to perform various procedures on that infant. At typical infant warmer is shown and described in U.S. Pat. No. 5,474,517 of Falk et al as prior art to that patent.

There are also infant incubators and which are more confined enclosures that contain the infant within an enclosed controlled atmosphere in an infant compartment that provides heat to the infant and also may provide control of humidity in the enclosed environment. Such incubators maintain the infant for long periods of time and include handholes to access the infant. Generally, there is, in addition, a larger access door that can be opened to access the infant or to insert or remove the infant to and from the incubator. Such devices provide a good atmosphere to the infant and control that local environment within which the infant is located, however, it is sometime difficult to perform a wide variety of procedures on the infant due to the somewhat limited access to that infant. A typical infant incubator is shown and described in U.S. Pat. No. 4,936,824 of Koch et al.

At the present, there are also certain infant care apparatus that combine the functions of an infant warmer and an incubator. One such apparatus is shown and described in U.S. Pat. No. 3,858,570 of Beld et al where an overhead canopy or dome is movable between a position where it covers the base to form an environmental chamber and an upper position where the radiant energy is directed toward the infant but the environmental chamber is open to access the infant by the attending personnel. Accordingly, there is a means of lifting the dome between the various vertical positions. In the Beld et al patent, the dome is balanced with respect to its weight by a plurality of springs, however the dome itself can be moved only by manually lifting and lowering the dome. As such, therefore, although manual lifting is a viable operation for domes in such infant care apparatus, it would be preferable to have an automated mechanism that can raise and lower the dome without a user physically causing the movement of the dome.

Similarly, in Donnelly et al, U.S. Pat. No. 5,453,077, there is an upper canopy that can be raised and lowered, however, the description only refers to a piston and a cylinder that is powered by a motor and does not provide a detailed description of how the mechanism operates. It is believed that in the event of a power failure, the canopy of Donnelly et al would be fixed in the particular position when the power failure occurred as there is no specific mechanism noted that would allow the canopy to be moved if the motor were inoperative.

It is preferred that the overhead canopy or hood structure be supported by a pair of vertical frame members so that the unit is rigid and can be supported by at least two areas for support of the canopy. In such instances, in order to raise and lower the canopy or other structure, various mechanisms have been used, including the use of a motor in each of the vertical frame members. Unfortunately, the two motors have to be very precisely coordinated so as to make sure they both raise each vertical frame member exactly simultaneously and at the same rate of speed to prevent binding when one member is elevated or lowered at a different rate. The use of multiple motors and the consequent synchronization of the motors is, therefore, relatively expensive, complicated and subject to difficulties in operation.

Accordingly, it would be advantageous in such apparatus to provide a lifting mechanism that can be easily powered by a standard, inexpensive singular motor to raise and lower the canopy. It would be further advantageous for the canopy to be supported by a plurality of vertical frame members for enhanced stability and yet be able to be raised and lowered without resort to expensive motors and precise control between the motors.

In addition, it would be advantageous, particularly with infant care equipment, if the raising and lowering of the canopy be performed automatically and not manually, be stable in the event of a power failure to the motive means and yet also have the capability of manually moving the canopy in the event of that power failure.

SUMMARY OF THE INVENTION

Accordingly, the present invention relates to an infant care apparatus that has an overhead canopy that can be automatically raised and lowered by a motive means so that the user does not have to manually position the canopy.

In carrying out the present invention, the canopy is provided with a constant force spring mechanism that achieves a neutral, or essentially neutral, weight for the canopy, that is, the constant force spring mechanism is designed to offset and essentially counterbalance the weight of the canopy and the associated peripheral structure. Therefore, the canopy can be raised to any position, be essentially counterbalanced at that position, and thus remain at that position without the need for any locking mechanism. As such, the actual moving of the canopy is relatively easy and can be accomplished by an inexpensive motive means such as an electric gear motor. In addition, due to the neutral, or essentially neutral, weight balance provided by the constant force spring mechanism, the motor can be small and yet have sufficient torque to carry out the raising and lowering of the canopy without difficulty.

Again, due substantially to the neutral weight balancing provided by the constant spring mechanism, the system enables the use of two vertical frame members on which the canopy can be positioned in a stable manner and yet the motor can be located in and operate only one of the vertical frame members to raise and lower the canopy, thus no intricate coordination between separate motors is needed and the motor itself can be an inexpensive motor.

In addition, the system allows the canopy to be easily manually moved by the user even in the event there is a power loss to the motor or to some other functioning problem. In such case, therefore, and which can be critical when dealing with an infant warming apparatus, the user can carry out manual moving of the canopy even when the motor has been disabled and is thus a safety feature inherent in the present inventive system.

These and other features and advantages of the present invention will become more readily apparent during the following detailed description taken in conjunction with the drawings herein.

DETAILED DESCRIPTION OF THE INVENTION

Figure 1:
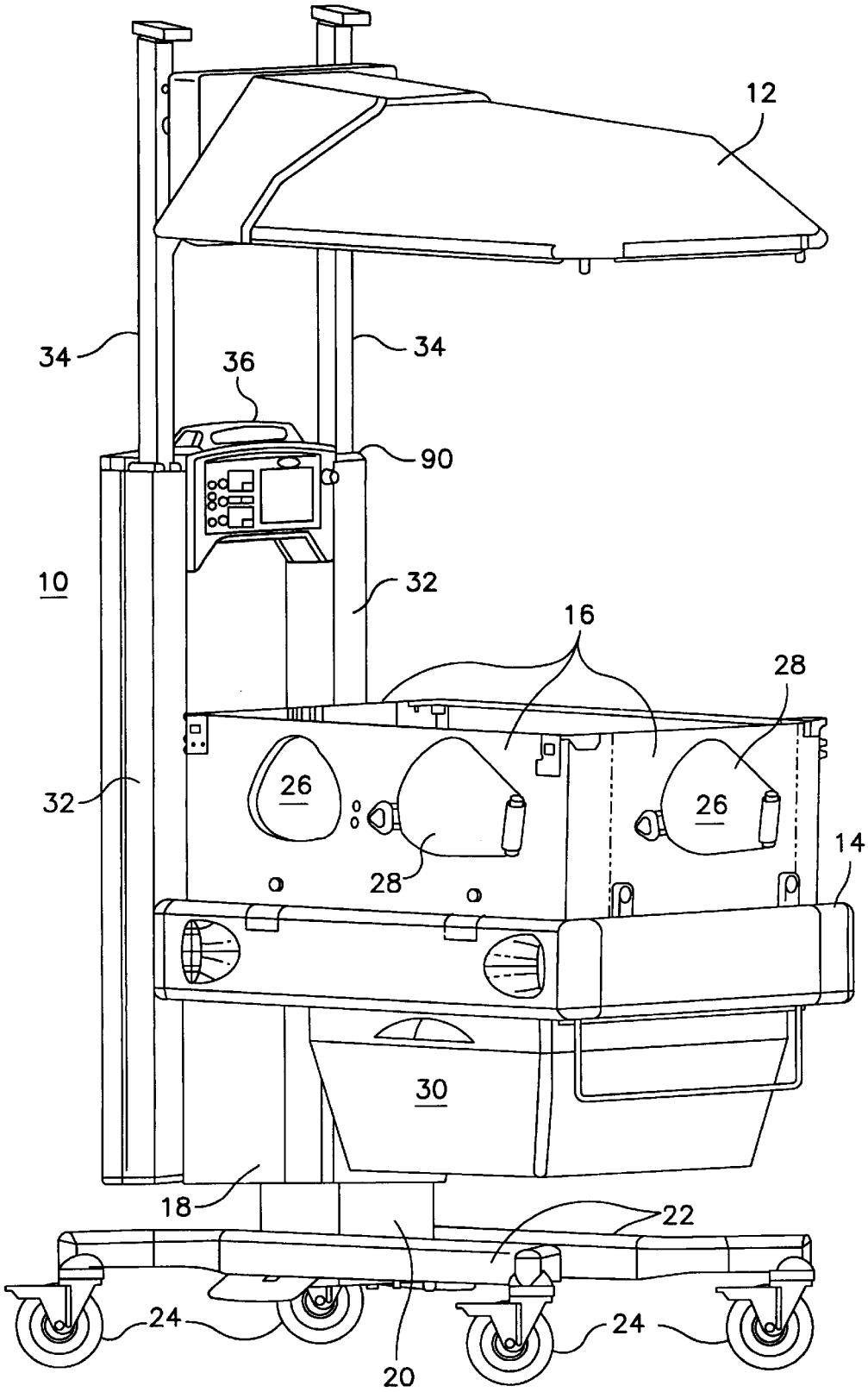
FIG. 1 of a perspective view of the infant warming apparatus constructed in accordance with the present invention wherein the canopy containing a radiant heater is shown in its upper position.
Figure 2:
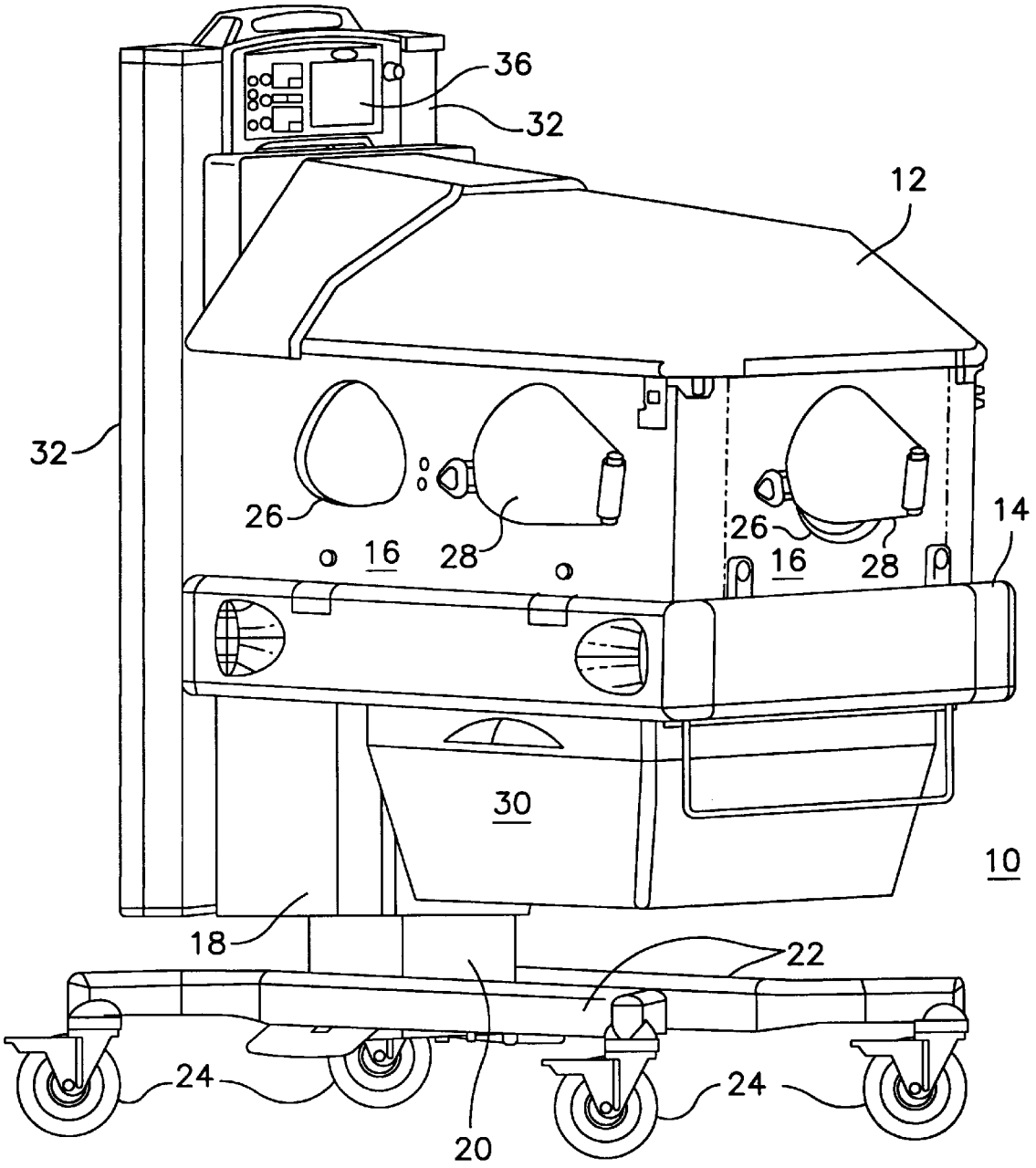
FIG. 2 is a perspective view of the apparatus of FIG. 1 but showing the canopy in its lower position.

Referring now to FIG. 1, there is shown a perspective view of an infant warming apparatus 10 constructed in accordance with the present invention with the canopy 12 in its upper position. Referring also to FIG. 2, there is a perspective view of the infant warming apparatus 10 as shown in FIG. 1 but with the canopy 12 in its lower position. As will be understood, in the FIG. 1 position, the infant warming apparatus 10 acts as an infant warmer with considerable access to the infant for performing interventions on the infant and in the FIG. 2 configuration, the infant warming apparatus 10 acts as an incubator with the infant confined within a protective environment and having a controlled atmosphere to provide warmth as well as controlled humidity.

As shown, the infant warming apparatus 10 includes an infant pedestal 14 that underlies and supports an infant. As is also seen, a plurality of walls 16 are provided to contain the infant safely within the infant warming apparatus 10 and are located at all of the four sides of the infant pedestal 14. The walls 16 are preferable constructed of transparent plastic material and, as will be explained, cooperate with other components in order to provide an incubator function to the infant warming apparatus 10 when in the FIG. 2 configuration.

The infant pedestal 14 is mounted to a vertical movable base member 18 which, in the preferred embodiment, is movably affixed to a stationary vertical base member 20, which, in turn, is mounted to a base 22 having wheels 24 for ready movement of the infant warming apparatus 10.

The vertical movable base member 18 is preferably mounted so that the user can adjust the height of the infant pedestal 14 by raising and lowering the movable vertical member 18 as desired, thus the infant pedestal 14 can be adjusted to the preferred height by the user. As further standard features, the walls 16 have handholes 26 to afford access to the infant when in the incubator configuration of FIG. 2, and which generally have doors 28 that can be opened to obtain access to the infant and, of course, closed when the particular intervention has been completed to preserve the desired environment surrounding the infant.

Another convenient feature includes a drawer 30 to retain supplies or other devices needed to carry out some operation on the infant and which is normally located beneath the infant pedestal 14. Other features include the maneuverability of the walls 16 that are pivotally mounted at their bases to the infant pedestal 14 such that the doors can be swung outwardly and downwardly and, as a further alternative, can be easily fully removed from the infant pedestal 14. As such, therefore, when the canopy 12 of the infant warming apparatus 10 is in its upper position as shown in FIG. 1, the walls 16 can be dropped downwardly or removed altogether so that the attending personnel can have unlimited access to an infant resting on the infant pedestal 14 to perform interventions on that infant.

Further structural components of the infant warming apparatus 10 include stationary frame members 32 that are affixed to the base member 18 and, as shown, there are two vertical stationary frame members 32 in the preferred embodiment although there may be only one or there may be further numbers of such members. Two vertical movable frame members 34 are movably fitted into the stationary frame members 32 and which can be moved upwardly and downwardly by the user as will be explained.

A control module 36 is conveniently positioned intermediate the stationary frame members 32 and may include displays of various monitored parameters as well as include the various controls for operation of the functions of the infant warming apparatus 10.

As may now be seen in general, in the operation of the infant warming apparatus 10, the canopy 12, in the preferred embodiment, houses a radiant heater (not shown in FIGS. 1 and 2) and as will be later explained. The canopy 12 can be moved between its lower position as shown in FIG. 2 and its upper position as shown in FIG. 1 depending upon the mode of operation desired by the user. In the upper position of FIG. 1, the infant care apparatus 10 functions as an infant warmer where there is full access to the infant and where an overhead radiant warmer supplies heat to maintain the infant with sufficient warmth. In the lower position of FIG. 2, the infant warming apparatus 10 functions as a normal incubator, since the outer periphery of the infant canopy 12 fits fully over the upper edges of the walls 16 to form therein, an infant compartment that is provided with warm air and controlled humidity in the normal functioning of an incubator.

Figure 3:
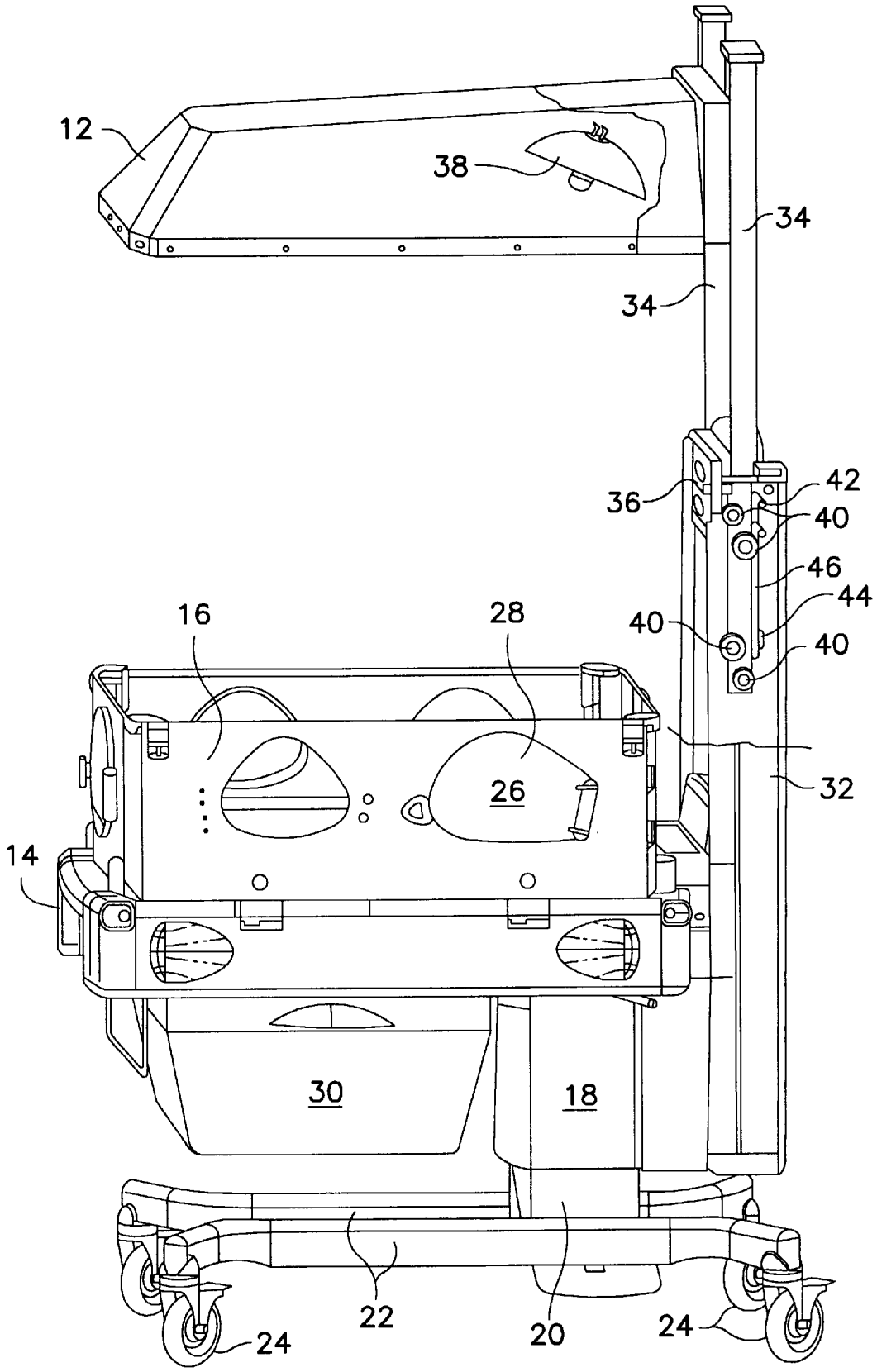
FIG. 3 is a side perspective view of the infant warming apparatus, partly in section, showing the canopy in its upper position.

Turning now to FIG. 3, there is shown a perspective view, partially cut away, and illustrating the mechanism that enables the raising and lowering of the canopy 12 to move the canopy 12 between its upper position and its lower position. In this Figure, there can be seen a radiant heater 38 that is used in the preferred embodiment. In the present description, the preferred embodiment is illustrated where the lifting mechanism for the canopy is used with an infant care apparatus, however as will become evident, the present canopy lift mechanism can be used with any apparatus where there is a canopy or other structure that is raised and lowered and thus has a wide variety of other uses outside of the field of infant care equipment.

Continuing with FIG. 3, therefore, it can be seen that the movable frame members 34 fit within and are movably affixed to the stationary frame members 32 and that the canopy 12 is in its upper position. A plurality of rollers 40 are provided that are rotatably affixed to the movable frame members 34 and roll against and are supported by the internal surfaces of the stationary frame members 34. As such, therefore, the rollers 40 enable a stable base to the movable frame members 34 and also allow those movable frame members 34 to be freely raised and lowered with an minimum of friction and other inhibiting measures.

As is also shown in FIG. 3, a pair of constant force springs 42 are positioned so as to be affixed to the stationary frame members 32 at the upper portion thereof. Such constant force springs are readily available and comprise a main coil of steel tape having a main axis that is affixed in position. As the free end of the constant force spring is extended from the main coil, a force is created counter to the extending of the free end and that force tends to pull the free end toward the coil to be recoiled. The advantage is that the constant force spring does generally provides a constant force biasing the free end of the steel tape towards the main coil of the tape and is relatively independent of the length of free tape unwound from the main coil.

In the present invention, therefore, the free ends 44 of the steel tape 46 are affixed to the movable frame members 34 at the bottom thereof. Therefore, as the canopy 12 affixed to the movable frame members 34 moves between its lower position to its upper position, the constant force springs 42, having their main coils affixed to the stationary frame members 32 and their free ends 44 affixed to the movable frame members 34, create a bias that can be designed by selection of the proper constant force springs 42 that offsets and counterbalances the weight of the canopy and its associated equipment. As such, the canopy 12 and its structural components supported thereby, can be neutrally, or essentially neutrally, balanced so that the canopy 12 can be moved to any position between its lower position and its upper position and will be stable in that selected position and will not fall downwardly even if left unattended. Obviously, the latter result could be hazardous to persons working on an infant contained within the infant care apparatus.

As shown in FIG. 3, there are two constant force springs 42 used with one set of a movable frame member and stationary frame member, and in the preferred embodiment, there are basically two sets of movable and stationary frame members to provide strength and rigidity to the support of the canopy 12. Thus, accordingly, in the preferred embodiment, there are two constant force springs 42 used with each of the two sets of movable and stationary frame members. Obviously, the number and size of the constant force springs can be chosen by the designer, however it is advantageous that the springs be somewhat balanced between the sets of movable and stationary frame members where a multiple of such sets is utilized.

Figure 4:
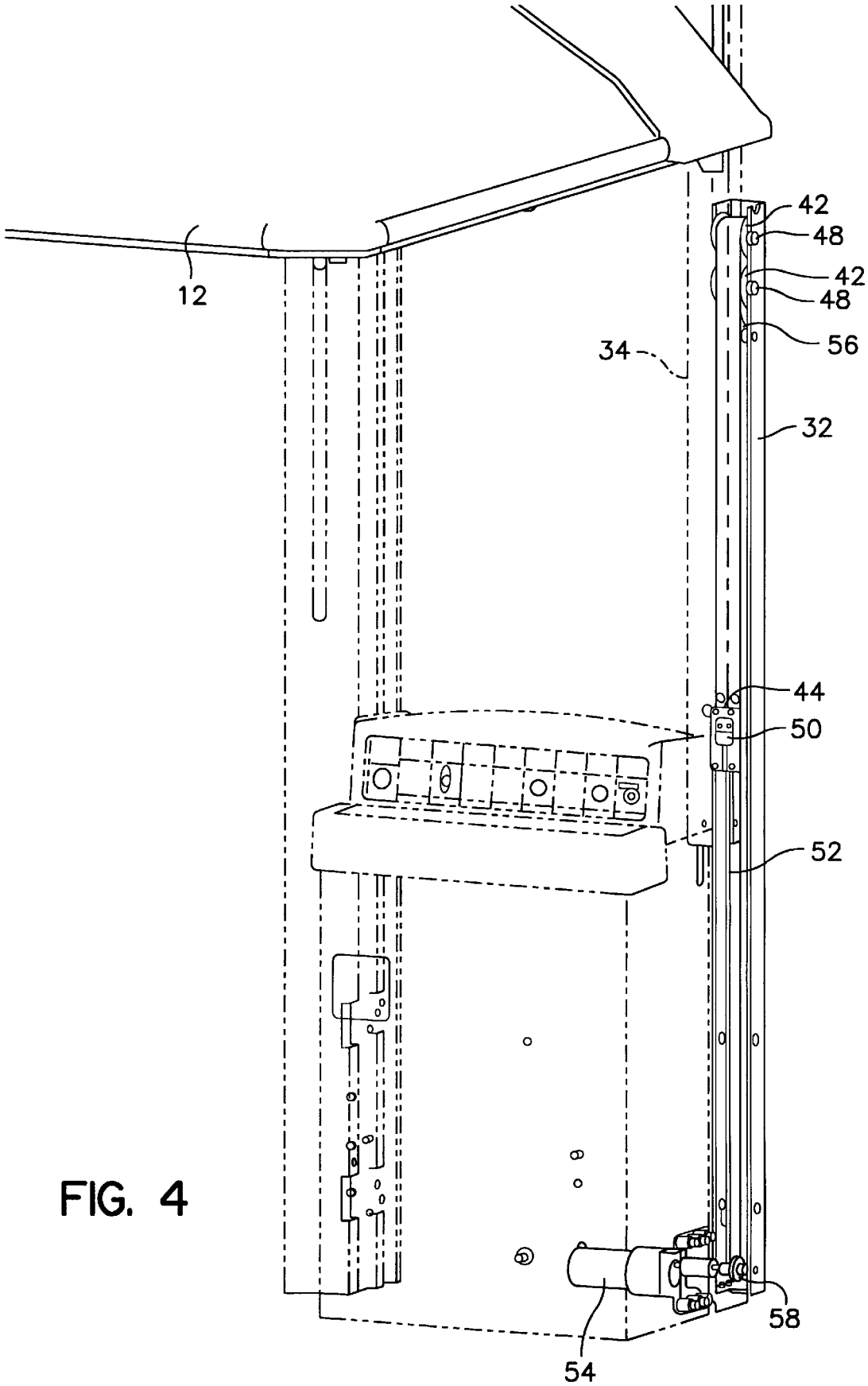
FIG. 4 is a further side perspective view, partially cut away, and illustrating additional components used to carry out the present invention.

Turning now to FIG. 4, there is shown a side perspective view, partially cut away, and illustrating further components used in carrying out the present invention. In the Figure, the constant force springs 42 are shown having their main coils fixed in position with respect to the stationary frame members 32 by being inserted into suitable shaped fixed notches 48 that can conveniently be used to install and support the constant force springs 42 in a fixed position. The free ends 44 of the constant force springs 42 are affixed to the movable frame members 34 by means of a tensioning block 50 that will be described in more detail later.

It is sufficient, at this time, to note that the free ends 44 of the constant force springs 42 are affixed to the movable frame members 34 (shown in phantom) near the lower portion thereof so that the canopy 12 can be raised to its upper position and the constant force springs 42 will provide a balancing against the weight. As indicated, the use of the neutral balancing allows the canopy 12 to be moved to any position and the weight of the canopy 12 and its other components that move with the canopy 12 are counterbalanced by the constant force springs 42. At times herein, the counterbalance will be described for the convenience of a brief description as being neutrally counterbalanced, however, it is sufficient that the counterbalancing be essentially or nearly counterbalanced since an exact counterbalance is somewhat difficult to achieve and not necessary for the purposes of the present invention. As will be seen, however, it is important to achieve essential counterbalancing so that the canopy 12 will not rapidly descend in the event of a failure of certain components used in the overall system.

Also affixed to the tensioning block 50 are the ends of a flexible belt 52 that interconnects the movable frame member 34 and a motive means such as motor 54 to power the movement of the canopy 12 between the upper and lower positions. The motor 54 can be a gear motor, preferably not of the worm gear type, so that the canopy 12 can be manually free wheeled by the user by physically moving the canopy 12 as will be later explained. The flexible belt 52 is connected between an upper sprocket 56 that is affixed to the stationary frame member 32 and a motor sprocket 58 that is connected to and rotated by the particular drive of the motor 54. As previously explained, the flexible belt 52 is also connected to the movable frame member 34 by means of the tensioning block 50 that is affixed to the movable frame member 34 such that rotation of the motor 54 will cause the movable frame member 34 to be raised and lowered so as to be positionable in its upper and lower positions.

Figure 5:
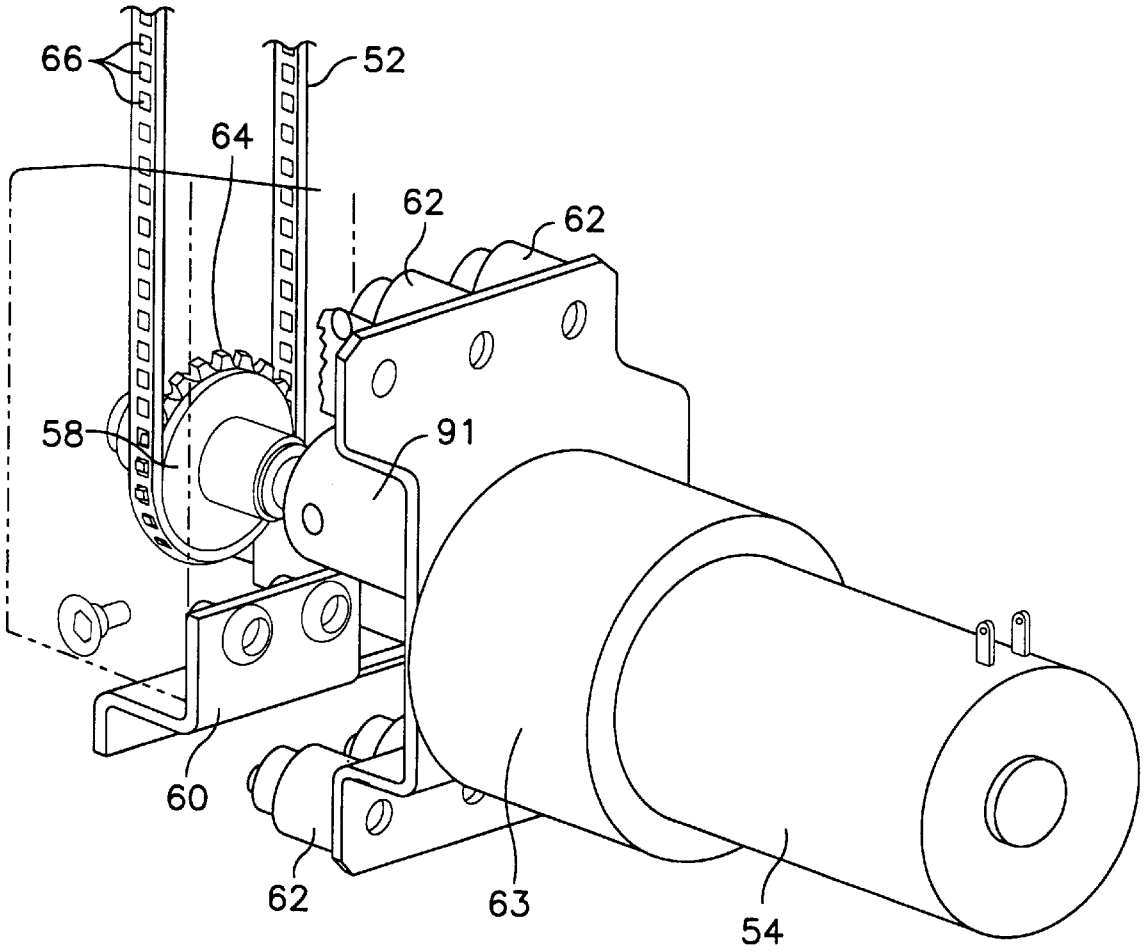
FIG. 5 is an enlarged perspective view, partly cut away, illustrating the motive means used to carry out the present invention.

Turning now to FIG. 5, taken in connection with FIG. 4, there is shown an enlarged rear perspective view of motor 54 illustrating its affixation to the overall infant warmer apparatus 10 as well as the motor sprocket 58 and its operation in providing the motive force to the flexible belt 52. In the Figure, the motor 54 is preferably affixed to the stationary frame member 32 by means of a bracket 60 and includes vibration dampers 62 to reduce the effect of the motor vibrations on the other components of the infant care apparatus. A gear train 63 can be directly connected or unitary with the motor 54 to achieve the desired motor speed for moving the canopy 12 upwardly and downwardly. A flexible coupling 91 interconnects the motor 54 and the motor sprocket 58 so as to reduce the effect of motor vibrations on the other components of the infant care apparatus.

Motor sprocket 58 along with the flexible belt 52 can conveniently be located within stationary frame member 32 so as to be out of view of the user and yet be fully functional in moving the canopy 12. As will also be noted, the motor sprocket 58 is provide with teeth 64 to make a positive connection to the flexible belt 52 having corresponding openings 66 to intermesh with the teeth 64. Thus the connection between the motive power supplied by the motor 54 and the flexible belt 52 that, in turn, interconnects with the movable frame member 34 is a positive chain of connection.

Figure 6:
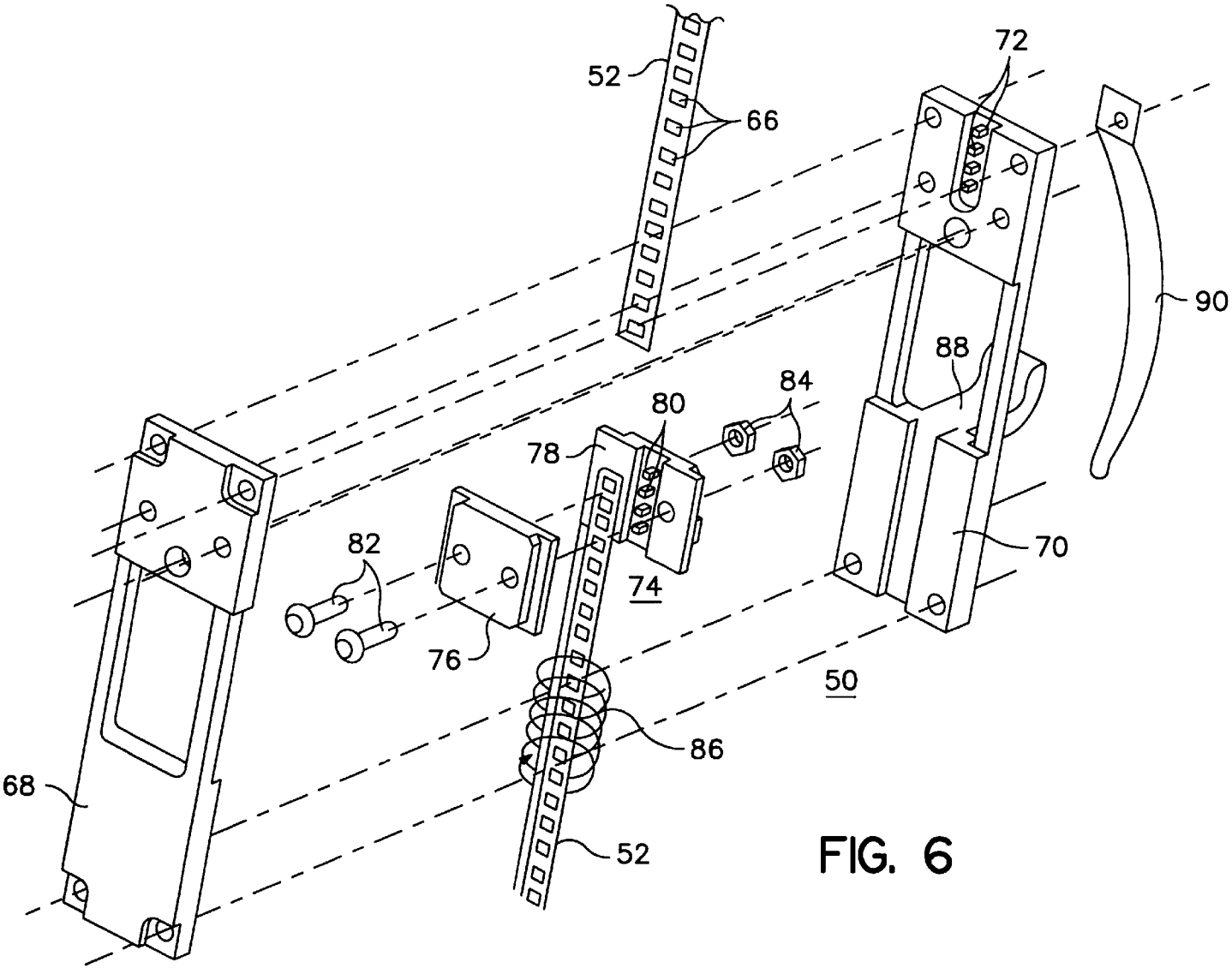
FIG. 6 is an enlarged, exploded perspective view of a further component used in carrying out the present invention.

Turning, finally to FIG. 6, there is shown an exploded view of the tensioning block 50 constructed in accordance with the present invention. The tensioning block 50 comprises a pair of frames 68 and 70, with the frames adapted to be mounted to the movable frame member (FIG. 4) by means such as screws that pass through both of the frames 68 and 70 and screw into the movable frame member 34. One of the frame members 70 has a plurality of projections 72 that extend outwardly and are adapted to retain one end of the flexible belt 52. Those projections 72 enter into and secure thereto the openings 66 in the flexible belt 52 so that the flexible belt is securely affixed to the tensioning block 50. A movable block 74 is retained intermediate the two frames 68 and 70 and which is movably affixed therebetween. The movable block 74, similar to the tensioning block 50 comprises two sections 76 and 78 where the section 78 also has projections 80 that extend outwardly and which intermesh with the openings 66 in the flexible belt 52 to secure the other end of the flexible belt 52 to the tensioning block 50. As shown, in assembly, the two sections 76 and 78 are secured together to retain the flexible belt 52 therebetween and can be affixed together by means such as screws 82 and nuts 84.

A spring 86 is positioned between the movable block 74 and a flat projecting base 88 formed in the frame 70 such that the spring 86 is compressed during assembly and remains in the compressed state to create a bias upwardly against the movable block 74 and, accordingly, create a tension in the flexible belt 52 of the desired amount to keep the flexible belt 52 taut during operation of the canopy moving mechanism. In the use of the tensioning block 50, of course, the tensioning block 50 is affixed to the lower portion of the movable frame member 34 (FIG. 3) so that the movement of the flexible belt 52 causes the movable frame member 34 to move upwardly and downwardly to move the canopy 12 between its upper and lower positions.

A leaf spring 90 is also included and which is utilized to trip various sensors that are positioned along the travel of the tensioning block 50 to indicate the position of the canopy 12 for purposes basically unrelated to the present invention.

Those skilled in the art will readily recognize numerous adaptations and modifications which can be made to the infant care apparatus of the present invention which will result in an improved control system, yet all of which will fall within the scope and spirit of the present invention as defined in the following claims. Accordingly, the invention is to be limited only by the following claims and their equivalents.

We claim:

1. An infant care apparatus, said apparatus comprising an enclosure having a surface on which an infant is adapted to be positioned, at least one vertical member being fixed in a stationary vertical position and extending upwardly from said surface, a canopy mounted to said at least one vertical member, said canopy being movable between a lower position wherein said canopy fits over said enclosure to form a closed infant compartment and an upper position where said canopy is elevated with respect to said enclosure and said infant compartment is open, a mechanism for raising and lowering said canopy with respect to said enclosure to open and close said infant compartment, said mechanism comprising a constant force spring means positioned between said canopy and said enclosure, said constant force spring means adapted to essentially counterbalance the weight of the canopy, and an electric motor mounted in said apparatus mechanically interconnected to said canopy to raise and lower said canopy.

2. An infant care apparatus as defined in claim 1 wherein said canopy includes a radiant heater.

3. An infant care apparatus as defined in claim 1 wherein said constant force spring means comprises a plurality of constant force springs.

4. An infant care apparatus as defined in claim 1 wherein said at least one vertical member comprises two vertical members.

5. An infant care apparatus as defined in claim 1 wherein said at least one vertical member comprises two stationary vertical members and two movable vertical members, said movable members being movable interconnected to said stationary members and said canopy is affixed to said movable members.

6. An infant care apparatus as defined in claim 5 wherein said interconnection between said motor and said canopy comprises a flexible belt.

7. An infant care apparatus as defined in claim 6 wherein said flexible belt is located within one of said vertical members.

* * * * *